United States Patent [19]

Strauss et al.

[11] 4,182,626

[45] Jan. 8, 1980

[54] PRODUCTION OF GRANULAR COMPOSITIONS CONTAINING PULVERULENT MAGNESIUM

[75] Inventors: Georg Strauss; Wilhelm Portz, both of Erftstadt; Albert Braun, Hürth-Burbach, Joachim Kandler, Erftstadt; Klaus Komorniczyk, Kerpen; Hans-Dieter Thiel, Hurth, all of Fed. Rep. of Germany

[73] Assignee: Hoechst Aktiengesellschaft, Fed. Rep. of Germany

[21] Appl. No.: 917,377

[22] Filed: Jun. 20, 1978

[30] Foreign Application Priority Data

Jun. 25, 1977 [DE] Fed. Rep. of Germany ..... 2728744

[51] Int. Cl. ..... C21C 7/02

[52] U.S. Cl. ..... 75/58; 75/53

[58] Field of Search ..... 75/53, 58

[56] References Cited

U.S. PATENT DOCUMENTS

| | | | |
|---|---|---|---|
| 3,929,464 | 12/1975 | Todd | 75/58 |
| 3,998,625 | 12/1976 | Koros | 75/53 |

*Primary Examiner*—P. D. Rosenberg

*Attorney, Agent, or Firm*—Connolly and Hutz

[57] ABSTRACT

Granular compositions containing pulverulent magnesium are made by blending the pulverulent magnesium ingredient with the desired other ingredient(s). To this end, a premix is formed by mixing, in a first stage, the pulverulent magnesium with the other ingredient(s) in a ratio by weight of 4:1 to 1:19; and intimately mixing this pre-mix, in a second stage, with further proportions of said other ingredient(s) giving a total ratio by weight of 1:799 to 1:19.

6 Claims, No Drawings

PRODUCTION OF GRANULAR COMPOSITIONS CONTAINING PULVERULENT MAGNESIUM

This invention relates to a process for making granular compositions containing pulverulent magnesium, including more especially compositions which contain pulverulent magnesium metal in admixture with a major proportion of a fine particulate alkaline earth metal compound and which are suitable for use in the desulfurization of an iron melt, the compositions being made by blending the pulverulent magnesium ingredient with the desired other ingredient(s).

It is generaly known that magnesium powder is very liable to undergo self-ignition in air, and, for this reason, it is not easy to handle in commercial quantities. Needless to say, therefore, in production localities in which pure magnesium powder is to be handled, it is an imperative requirement to take all steps necessary to avoid the ignition of explosible magnesium powder-air mixtures.

These are requirements which are relatively easy to meet in small production facilities. In high-capacity production facilities, however, they can only be met at the price of heavy capital investment which may seriously prejudice the commercial attractiveness of the production and manipulation of the magnesium powder in the facilities concerned.

In the production of compositions containing pulverulent magnesium for use in the desulfurization of an iron or steel melt, it has long been customary (cf. Comparative Examples 1 and 3 hereinafter) to use the individual ingredients in those weighed proportions which are necessary to establish a desirable final concentration; thus we used 99 kg of calcium carbide and 1 kg of pulverulent magnesium in Example 1, and we used 90 kg of calcium carbide, 9 kg of limestone and 1 kg of pulverulent magnesium in Example 3.

In the case of the magnesium powder, it has heretofore been necessary for the desired weight to be taken from a special container with a capacity of up to 50 kg.

Next, the individual ingredients were placed in a large mixer (commonly a 400 liter mixer), and mixed therein over a period of 30 minutes.

In view of the fact that pulverent magnesium, sometimes in quite considerable quantities, has to be handled during all these operations, i.e. during the weighing and introduction of the ingredients into the mixer, it has naturally been an imperative requirement to take all those steps which are necessary to avoid the ignition of the magnesium powder, or, in the event of the magnesium powder actually undergoing ignition, to ensure the safety of, or to afford protection for, the operating personnel. To this end, it has more particularly been necessary to render all electrical installations explosion-proof, to install alarm and escape facilities, and to keep life-saving and fire-combatting agents available, so as to comply with inter alia the requirements of the relevant industrial legislation.

In accordance with our present invention, we have now unexpectedly found that the burden of precautionary measures can be lightened to a considerable extent if the starting materials are mixed together in certain proportions in two separate stages, whereby a preliminary mixture (hereinafter called simply a "pre-mix") is formed in a first stage, and the ingredients not present in this pre-mix are subsequently added to and mixed with it in a second stage.

Thus according to the present invention, we provide a process for making a granular composition containing pulverulent magnesium, e.g. a composition which contains pulverulent magnesium metal in admixture with a major proportion of a fine particulate alkaline earth metal compound and which is suitable for use in the desulfurization of an iron melt; the composition being made by blending the pulverulent magnesium ingredient with the desired other ingredient(s); which process comprises: forming a pre-mix by mixing, in a first stage, the pulverulent magnesium with the other ingredient(s) in a ratio by weight of 4:1 to 1:19; and intimately mixing this pre-mix, in a second stage, with further proportions of said other ingredient(s) giving a total ratio by weight of 1:799 to 1:19.

Preferably the pulverulent magnesium is mixed, in the first stage, with the other ingredient(s) in a ratio by weight of 1:1 to 1:9. Preferably the pre-mix prepared in the first stage is mixed, in the second stage, with further proportions of the said other ingredient(s) giving a total ratio by weight of 1:499 to 1:39. The other ingredient(s) which may more preferably be mixed with the pulverulent magnesium comprise(s) one or more of the following: calcium carbide, calcium oxide, comminuted limestone or another form of calcium carbonate, dolomite.

The ingredient(s) to be mixed with the pulverulent magnesium should preferably be used in the form of particles with a size of 0.06 to 3.0 mm, and the magnesium should preferably be used in the form of particles having a size of 0.060 to 0.095 mm.

One of the advantages which are obtainable in the process of this invention is that dilute magnesium powder which is easier and safer to handle can be used during that period of the mixing operation which requires the greatest care. It is also possible to have the pre-mix prepared by the manufacturers of the pulverulent magnesium, who can be expected to have the technical facilities necessary to handle this material. Mixtures which contain 80% of magnesium powder or less are not hazardous to use.

It is therefore good practice in preparing the pre-mix to use the staring materials in proportions which permit a magnesium content of 80%, or, and preferably, less than 80%, e.g. 50%, to be established therein. When this has been done, it is quite safe to mix 5 weight % proportions of the pre-mix with the remaining 95 weight % proportions of the starting materials, without the need to take any special precautionary measures.

Further advantages of the process of this invention are that the present two-stage preparation can be carried out in a mixing period which is 30 to 50 % shorter than the time needed for directly mixing the starting materials together, and that the starting materials are unexpectedly considerably less liable to undergo particle separation.

The following Examples illustrate the invention, which is not, however, limited thereto:

EXAMPLE 1: (Comparative Example)

A 400 liter mixer similar to a concrete mixer was charged with 99 kg of commercial grade calcium carbide (particle size=0.3 to 1.0 mm) and 1 kg of pulverulent magnesium (particle size=0.060 to 0.095 mm), these materials occupying a volume of about 120 liters. The mixer, which was provided in its interior with guide plates, run for 40 minutes at a speed of about 40 rpm. Specimens were taken from the middle of the bed of material being mixed, and near the periphery of the mixer, at intervals of 5 minutes, and inspected for homogeneity.

Even after a mixing period of 15 minutes, the specimens were found to present streak-like differences in coloration due to different pulverulent magnesium concentrations.

The specimens were tested for their content of magnesium. Only after a mixing period of 30 minutes were they found to contain approximately 1.0% of magnesium.

EXAMPLE 2: (Invention)

9 kg of calcium carbide (particle size=0.3 to 1.0 mm) and 1 kg of pulverulent magnesium (particle size=0.060 to 0.095 mm) were made into a pre-mix in the mixing vessel of a gyro wheel mixer with a capacity of about 80 liters. Investigations showed the mixture to be quasi-homogeneous after a mixing period of only 5 minutes.

The resulting 10 kg of pre-mix was placed in the mixer described in Example 1 and mixed therein with 90 kg of calcium carbide (particle size=0.3 to 1.0 mm) to give a final mixture containing 1.0% of magnesium. After a mixing period of only 5 minutes, the mixture was free from streaks such as those described in Example 1. After a mixing period of 10 minutes, a 1.0% content of magnesium was found to have been established in the mixture.

The total mixing time was 15 minutes, in contrast with 30 minutes in Example 1.

In order to evaluate the risk of phase separation during transport, the mixtures of Examples 1 and 2 were tested for their tendency to particle separation.

To this end, 100 g specimens were placed in a glass tube which was about 200 mm long and about 40 mm wide, and of which one end was closed by means of a wood plug. The glass tube was mounted in an upright position on a settling device of the type used for determining a tamped density in accordance with DIN (German Industrial Standard) 53149. By means of this device the glass tube was repeatedly lifted by a few mm and allowed to drop back to its original level.

The number of distinct settling operations performed by this device was preselectable. During these settling operations, the calcium carbide was indeed settled, but the fact that it was free from particles with a size of less than 0.3 mm enabled the considerably finer magnesium particles to drop downwardly through the calcium carbide particles. After 500 of the above-mentioned distinct settling operations, the glass tube was taken off the settling device; a specimen was taken from the upper surface portion of its contents, and, after removal of the wood plug, another specimen was taken from the bottom portion of its contents. The two specimens were tested for their content of magnesium.

The difference between the content of magnesium determined for the specimen taken from the bottom portion of the contents of the glass tube and that determined for its upper surface specimen was 1.8% in the case of the mixture prepared in the manner described in Example 1, but in the case of the mixture of Example 2, this magnesium content difference was only 0.8%.

Substantially analogous results were obtained with three-component mixtures containing pulverulent magnesium which were prepared by mixing together the three components in question, in the manner described in Examples 1 and 2, respectively.

EXAMPLE 3: (Comparative Example)

90 kg of calcium carbide, 9 kg of comminuted limestone (particle sizes of both components were 1.0 to 3.0 mm) and 1.0 kg of pulverulent magnesium (particle size 0.060 to 0.095 mm) were placed in the mixer described in Example 1 and mixed. A mixing period of 30 minutes was again necessary for the formation of a homogeneous mixture. The resulting mixture was tested as before, for particle separation. The magnesium contents determined for the specimens taken from the bottom and surface portions of the contents of the glass tube were found to differ from one another by 1.9%.

EXAMPLE 4: (Invention)

In the gyro wheel mixer of Example 2, a pre-mix was made from 9 kg of comminuted limestone (particle size=1 to 3 mm) and 1 kg of magnesium (particle size=0.060 to 0.095 mm). To obtain this pre-mix, it was indeed necessary to mix the components over a longer period, viz. 10 minutes, but the final mixture: (formed as in Example 2 by mixing in 90 kg of calcium carbide) was obtained within a mixing period of altogether 20 minutes, i.e. within a period considerably shorter than the 30 minutes mentioned in Example 3. The resulting mixture was tested for particle separation in the settling device mentioned in Example 2. The magnesium contents were found to differ from one another by only 0.7%.

We claim:

1. A process for making a granular composition consisting of pulverulent magnesium metal in admixture with a major proportion of a fine particulate alkaline earth metal compound or a mixture of such compounds for using the composition in the desulfurization of an iron melt; the said composition being made by blending the pulverulent magnesium metal with the alkaline earth metal compound which process comprises: forming in a first stage a premix by mixing the pulverulent magnesium metal with the alkaline earth metal compound in a ratio by weight of 4:1 to 1:19; and intimately mixing in a second stage this pre-mix obtained with further proportions of said alkaline earth metal compound(s) giving a total ratio by weight of magnesium metal to alkaline earth metal compound(s) from 1:799 to 1:19.

2. The process as claimed in claim 1, wherein the pulverulent magnesium metal is mixed in the first stage with the alkaline earth metal compound(s) in a ratio by weight of 1:1 to 1:19.

3. The process as claimed in claim 1, wherein the pre-mix prepared in the first stage is mixed in the second stage with further proportions of the said alkaline earth metal giving a total ratio by weight of magnesium metal to alkaline earth metal compound(s) from 1:499 to 1:39.

4. The process as claimed in claim 1, wherein the alkaline earth metal compound(s) mixed with the pulverulent magnesium metal comprise(s) one or more of the following: calcium carbide, calcium oxide, calcium carbonate and dolomite.

5. The process as claimed in claim 1, wherein the alkaline earth metal compound(s) mixed with the pulverulent magnesium metal is or are used in the form of particles having a size of 0.07 to 3.0 mm.

6. The process as claimed in claim 1, wherein the pulverulent magnesium metal is used in the form of particles having a size of 0.060 to 0.095 mm.

* * * * *